US008425130B2

(12) United States Patent
Filipak et al.

(10) Patent No.: US 8,425,130 B2
(45) Date of Patent: Apr. 23, 2013

(54) PRINTER WITH MODULAR CARTRIDGE

(75) Inventors: Marcelo Filipak, Paraná (BR); Ricardo Trauer, Paraná (BR); Ricardo Dalla Pria, Paraná (BR); Danilo Emir De Bassi, Paraná (BR); Eduardo Ferreira, Santa Catarina (BR)

(73) Assignee: Bematech S.A., Sao Jose Dos Pinhais (BR)

( * ) Notice: Subject to any disclaimer, the term of this patent is extended or adjusted under 35 U.S.C. 154(b) by 1190 days.

(21) Appl. No.: 12/281,249

(22) PCT Filed: Mar. 6, 2007

(86) PCT No.: PCT/IB2007/050725

§ 371 (c)(1),
(2), (4) Date: Nov. 18, 2008

(87) PCT Pub. No.: WO2007/102121

PCT Pub. Date: Sep. 13, 2007

(65) Prior Publication Data

US 2009/0154949 A1 Jun. 18, 2009

(30) Foreign Application Priority Data

Mar. 6, 2006 (BR) ..... 0600440

(51) Int. Cl.
*B41J 11/44* (2006.01)

(52) U.S. Cl.
USPC ..... 400/76

(58) Field of Classification Search ..... 400/76
See application file for complete search history.

(56) References Cited

U.S. PATENT DOCUMENTS

| | | | | |
|---|---|---|---|---|
| 5,135,318 A | | 8/1992 | Hongo | |
| 5,808,283 A | | 9/1998 | Stanton et al. | |
| 5,927,878 A | * | 7/1999 | Kasai et al. | 400/691 |
| 6,118,469 A | | 9/2000 | Hosomi | |
| 6,155,731 A | * | 12/2000 | Bertalan et al. | 400/621 |

(Continued)

FOREIGN PATENT DOCUMENTS

| | | |
|---|---|---|
| BG | 61355 B1 | 6/1997 |
| BR | 9904636-9 A | 4/2001 |

(Continued)

OTHER PUBLICATIONS

Supplementary European Search Report from corresponding European Application No. EP07713203 dated Sep. 22, 2010.

(Continued)

*Primary Examiner* — Daniel Hess
*Assistant Examiner* — David Tardif
(74) *Attorney, Agent, or Firm* — Lando & Anastasi, LLP

(57) ABSTRACT

PRINTER (1) WITH MODULAR CARTRIDGE made up of a printing module (2) and a modular (3) cartridge, in independent cabinets but in the same printer, being that said modular cartridge can be fiscal or a non-fiscal cartridge. Said printing module (3) comprises at least a printing mechanism (4), a paper support (5), an auxiliary connection board (7), and the latter's connection to the control board (8). In fiscal cartridges, a fiscal control board is provided, comprising the devices responsible for all fiscal control functions and also for the printing control. In case of printers that do not need fiscal control, the control board can be simplified to a board with printing control function only, making up the so-called non-fiscal cartridges.

14 Claims, 10 Drawing Sheets

U.S. PATENT DOCUMENTS

| | | | | |
|---|---|---|---|---|
| 6,189,788 | B1 | 2/2001 | Sherman et al. | |
| 6,352,381 | B1 | 3/2002 | Gonmori et al. | |
| 6,474,883 | B1 | 11/2002 | Kawakami et al. | |
| 6,556,216 | B1 | 4/2003 | Cato et al. | |
| 6,682,239 | B2 | 1/2004 | Mori et al. | |
| 6,710,895 | B1 * | 3/2004 | Gatto et al. | 358/1.6 |
| 6,758,614 | B2 | 7/2004 | Yamada et al. | |
| 2002/0120851 | A1 * | 8/2002 | Clarke | 713/178 |
| 2003/0029339 | A1 | 2/2003 | Silverbrook | |
| 2003/0103793 | A1 | 6/2003 | Murakoshi et al. | |
| 2004/0255141 | A1 * | 12/2004 | Hodder et al. | 713/200 |
| 2005/0123336 | A1 | 6/2005 | Oshida et al. | |
| 2005/0162501 | A1 | 7/2005 | Seo et al. | |
| 2006/0104694 | A1 | 5/2006 | Montagutelli | |
| 2009/0219375 | A1 | 9/2009 | Trauer et al. | |

FOREIGN PATENT DOCUMENTS

| | | | |
|---|---|---|---|
| BR | 0106864-4 | A | 4/2003 |
| BR | 0402032-4 | A | 12/2005 |
| EP | 1114731 | A2 | 11/2001 |
| EP | 1506875 | A2 | 2/2005 |
| EP | 1469998 | B1 | 8/2008 |
| FR | 2845943 | A1 | 4/2004 |
| JP | 5-120567 | | 5/1993 |
| JP | 11-245476 | A | 9/1999 |
| JP | 2001-205896 | A | 7/2001 |
| JP | 2004074812 | A2 | 3/2004 |
| JP | 2004268207 | A2 | 9/2004 |
| JP | 2005-119109 | A | 5/2005 |
| JP | 2006-082315 | | 3/2006 |
| KR | 20-0158715 | | 10/1999 |
| KR | 10-0267732 | | 10/2000 |
| KR | 10-2001-0039109 | | 5/2001 |
| WO | WO 99/66465 | A1 | 12/1999 |
| WO | 0072262 | A1 | 11/2000 |
| WO | WO 03/064163 | A1 | 8/2003 |
| WO | WO 2005/090027 | A1 | 9/2005 |
| WO | WO 2007/102120 | A2 | 9/2007 |

OTHER PUBLICATIONS

Extended European Search Report dated Apr. 8, 2010 from European Application No. 07713204.1 and corresponding to International Application No. PCT/IB2007/050725.

Sales Taxes Agreement ICMS 156/94, Paragraph 13, subsection XI, section 11, Dec. 15, 1994 (Brazilian Official Gazette).

Sales Taxes Agreement ICMS 85/01, Paragraph 4, subsections V-II, Sep. 28, 2001 (103rd ordinary meeting—National Council for Finance Affairs).

Urgency Ordinance No. 28/1999, Norms 3.1 and 3.2.

International Search Report published May 8 2008 from corresponding PCT Application No. PCT/IB2007/050725.

Written Opinion dated Feb. 21, 2008 from corresponding PCT Application No. PCT/IB2007/050725.

International Search Report published Feb. 28, 2008 from related PCT Application No. PCT/IB2007/050724.

* cited by examiner

PRINTER WITH MODULAR CARTRIDGE

TECHNICAL FIELD

This invention refers to the technical field of compact devices for printing and issuing receipt tickets, more particularly to the details or auxiliary devices to prevent fraudulent operation.

BACKGROUND ART

In printing devices used in commercial operations, it is usual to generate a record of the operations, normally in two copies, being one copy for the establishment's control and another copy for the customer. Conventionally, this record contains the establishment's data, such as name, address and appropriate identification codes of the point of sale, date and time of operation and product data, such as name, unit price, total price, etc.

Initially, these two copies were printed, usually using carbon or another duplication means. With the technological development in the field of computing systems, electronic memories became more reliable and secure, allowing, for example, the establishment's copy to remain stored in these memories. Furthermore, electronic storage does not require the storing of a great amount of paper rolls like before, since records referring to transactions of the last five to ten years are kept and the storage capacity of these memories is quite greater than that of the said paper rolls. Also, the possibility of the establishment's copy being stored electronically allows choosing other printing forms, such as thermal printing, which before were not feasible due to the generation of printed copies by means or carbon or other similar method requires printing by impact method.

In some countries, the copy generated in the printer for commercial automation, which remains in the establishment, is also used for fiscal control of transactions made, also having specific national legislation, such as pertaining to the mode of executing this storage. In these countries, the printer for commercial automation that meets these requirements is also called a fiscal printer.

For example, in Brazil several laws called 'Conventions' were enacted following the evolution of equipment used in points of sales, ranging from mechanical, electromechanical, electronic recording machines to points of sales terminals. In Dec. 15, 1994, for example, Convention No. 156/94 was published, establishing regulatory norms for the use of Fiscal Receipt Issuing Equipment. Said Convention, for example, prevented the use of thermal printers, since the copy from the paper roll destined to remain in the establishment needed chemical reagent and had to be printed concomitantly with the printing of the first copy.

Meanwhile, the Brazilian Convention ICMS No. 85 dated Sep. 28, 2001 establishes hardware, software and general requisites to be observed in the development and approval of Fiscal Receipt Issuing Equipment. This convention establishes, for example, that the Fiscal Receipt Issuing Equipment must have a nonvolatile memory semiconductor device, without resources for deletion by electrical signal, for fiscal memory storage, and that is internally fixed, together with the associated hardware resources, which do not allow modifying stored data, in a receptacle that cannot be separated from the equipment structure, upon application of opaque resin enveloping the entire device. Also, the Fiscal Receipt Issuing Equipment must have a sealing system that, with the installation of up to two seals in the outer part of the Fiscal Receipt Issuing Equipment, physical access to the fiscal control board, fiscal memory storage device and printing mechanism control circuit is prevented, allowing physical access to actuators and sensors of this control circuit, provided they are not in the fiscal control board.

To meet these requirements, one conventionally uses a fiscal control board with all devices to control the printer for commercial automation, with a casing (preferably metallic) and an outer seal, the fiscal memory being fixed to the cabinet by means of a resin and connected electrically to the control board. Also, to prevent external access to this device, a metallic plate is placed on the outer interfaces.

Another example is found in Romania, where the methodological norm for application of Urgency Ordinance No. 28/1999 defines fiscal printers as devices that include a fiscal module, a fiscal memory, preferably of the EPROM type, and a long-duration storage device, being the said fiscal printers accessed as peripherals of a computer system. The fiscal printers can be unitary, with a single chassis; or modular, provided that the integrity and continuity of the connections with the fiscal module are guaranteed.

To meet the legal requirements, the fiscal printer must also contain devices that prevent access of unauthorized personnel, for example, by means of seals and physical security elements. Despite some similarities, there are several particularities in the fiscal legislations of each country, and the equipment must be adapted before entering a new market.

Even in countries without legal requirements, the use of special devices can be of interest to prevent frauds, or even to assure the establishment's management of greater security and reliability.

Therefore, the background art has several constructive arrangements that aim to protect the printer's control board, without impairing the printer's reliability, being that some arrangements are given below that propose different line ups of the devices in the printer.

For example, the Brazilian patent application published under no. BRPI9904636 describes a fiscal control module that controls, validates and keeps the data sent by the computer so as to guarantee that the information sent to the printer is secure, stored in the fiscal board. Said fiscal control module has a removable board to record the data, allowing reading the data from any computer.

The Brazilian patent application published under no. BRPI0402032 describes a fiscal document issuance controller that comprises a hardware device capable of identifying and storing data sent by a computer to a fiscal printer. The system writes information pertaining to the company in which the management system will be installed; it reads the data transmitted between the computer and the fiscal document printer; it sends through parallel port the information contained in the flash memory to an appropriate terminal.

The Brazilian patent application published under no. BRPI0106864 describes an improvement introduced in electronic module of non-volatile memory for storage, used in Fiscal Receipt Issuing Equipment, characterized by the fact that it comprises a non-volatile memory that enables storing the fiscal contents corresponding to the daily sales, being that said memory has protection system in 'hardware' that makes impossible to overwrite in the memory positions already presenting fiscal contents.

Other documents of the background art relate to fiscal functions and protection or fixation devices for electronic boards such as patent application published under numbers JP2006082315, KR20-0158715 and KR10-0267732.

DISCLOSURE OF INVENTION

Technical Problem

The solutions cited in the above documents and others existing in the background art, however, do not conveniently and effectively solve some problems existing in the technical field of portable machines for printing and issuing tickets equipped with auxiliary devices to prevent fraudulent operation.

Document no. BRPI9904636 describes a fiscal module that does not meet all fiscal requirements in effect in Brazil, since removal of the board in which the data of the transactions is stored does not characterize a resource 'in receptacle that cannot be separated from the equipment structure' (e.g. Brazilian Convention ICMS 85/2001, sub item 'b' of item 'V'), thus enabling frauds, since said board could be, for example, changed unduly. Also, the arrangement has low flexibility, being difficult to adapt to legislations with different requirements.

Document no. BRPI0402032 describes a hardware accommodated in a small cabinet connected in series between the computer and printer. In this configuration, the fiscal document issuance controller has processor, memory and all other components to control the fiscal operations. However, the printer itself already has processor and memory to control the printer, thus, this configuration has duplicated components, which makes the assembly unnecessarily expensive, since there is no redundancy because the fiscal operations depend only on the components from the fiscal document issuance controller's interior and the printing depends on the printer components.

Meanwhile, document no. BRPI0106864 is an arrangement of low reliability, since a failure in any part of the printer, for example, in the cutting mechanism, makes it impossible to use the entire assembly. In Romania, in case of equipment failure, there is the possibility of using a special book to record all transactions while the fiscal printer is being repaired. However, the legislation of countries like Brazil does not allow transactions to be made without the record by the fiscal printer itself. This way, eventual failures can cause significant losses in establishments with high number of transactions per day, since a new printer could only be installed in place of the damaged printer in the presence of a fiscal authority representative. It would therefore be necessary to await maintenance of the printer or visit of said fiscal agent; meanwhile, no transaction may be made using that equipment. Furthermore, the written record, as is allowed in Romania, takes much more time and is more laborious than the record made by the fiscal printer, in addition to requiring specific space for the storage since the records for the last ten years must be kept.

Furthermore, many of the problems presented by this equipment and that require maintenance are due to component wear and dirt build up in parts in which access is not allowed, so as to prevent fraud, like printer head, gearing, sensors and actuators. The Brazilian legislation, for example, exempts these parts from being protected by the outer seal system. Even thus, the existing equipment currently unnecessarily seals the entire equipment, including the abovementioned parts, rendering maintenance difficult due to the cares required to removal of the seal, like the filling of forms and payment of issuance fees required by the fiscal authority for the technician to justify the need for maintenance.

Even though the document no. JP2006082315 relates to receipt printer with extension fiscal function with electronic boards, the printer control board is arranged in the main body of printer, which requires at least two electronic control boards in the dissociated chassis.

Therefore, as one can see, the need remains to obtain a printer for commercial automation with high reliability and security against frauds but that at the same time is adaptable to different legal requirements according to the location where it will be used, without this leading to excessive increase in the amount of electronic equipment. In addition, maintenances in the non-fiscal parts of the printer are also allowed, without interfering in the continuous operation of the fiscal module.

Technical Solution

The aim of this invention, therefore, is to obtain a printer for commercial automation with high reliability and security against frauds. Another objective of this invention is to obtain a printer for commercial automation adaptable to the different legal requirements according to the location where it will be used.

Another objective of this invention is to obtain a printer for commercial automation that allows the maintenance of the said printer without interrupting the fiscal operations.

Furthermore, another objective of this invention is to obtain a printer for commercial automation that allows storage of the establishment's copy, for example, for five years without occupying large spaces.

To reach the abovementioned objectives and other purposes, this patent describes a printer for commercial automation made up of a printer module and a modular cartridge, in independent cabinets but contained in the same printer, being that said modular cartridge can be a fiscal cartridge or a non-fiscal cartridge. Said printing module also comprises at least a printing mechanism, preferably thermal printing, a support for paper roll, an auxiliary connection board, and the connection of the latter with the control board. In fiscal cartridges, a fiscal control board is provided, which consists of the devices responsible for all fiscal control functions and also for control of the printing. In said fiscal control board, components are arranged according to the local fiscal requirements, such as processor, memories and external interfaces. In case of printers that do not need fiscal control, the control board can be simplified to a board with printer control function only, making up the so-called non-fiscal cartridges.

Since it contains all fiscal components and components responsible for printing control, the fiscal cartridge can be removed in relation to the printing module without intervention of a fiscal representative. This way, the technical intervention is only necessary in cases of problems in the fiscal cartridge itself. Furthermore, to adapt to requirements of other countries' legislations, one only needs to make changes in the fiscal cartridge, the printing module remaining practically unchanged for any situation, even in places without fiscal requirements.

To avoid improper use of fiscal and non-fiscal printers that use the same printing module, ways of preventing replacing a fiscal cartridge by a non-fiscal cartridge were provided. This way, a fiscal printer cannot be used unduly as a non-fiscal printer and vice-versa. This effect is obtained by changing the electrical connection and functionalities between the fiscal control board that is in the fiscal cartridge and the auxiliary connection board, which is in the printing module, such that both modules are electrically or mechanically non-compatible. Thus, a printing module that is configured for use in a fiscal cartridge cannot be used with a non-fiscal cartridge and also a printing module configured for a non-fiscal printer can only be used with non-fiscal cartridges.

Advantageous Effects

The fiscal cartridge in an independent cabinet of the printing module allows adapting the fiscal cartridge according to the local requirements without causing changes in the printing module. For example, in a country that requires a different memory type, just redesign the fiscal cartridge, without modifying any device in the printing module, which greatly reduces the design cost as a whole. Furthermore, the solution proposed in this invention does not lead to duplication of control components, such as processor and memories. This represents a great advantage in relation to conventional systems, which are based on the principle that a fiscal printer is made up of a complete non-fiscal printer and another fiscal control board, specially developed to meet the fiscal legislations of each country. This solution of the conventional systems meets the need of having different solutions for each country, but requires the duplicity of many components, making the printer more expensive.

In situations of use without fiscal requirements, a non-fiscal cartridge is used that is very similar to the fiscal cartridge, but it is simplified, including only the components to drive and control the printing mechanism and the necessary external interfaces, such as parallel and serial interface. Said simplification allows a significant cost reduction of the printer, enabling its use as a printer for commercial automation in any situation.

The printer for commercial automation described in this invention, therefore, on allowing separation of said fiscal cartridge from the printing module without interrupting the functioning of the fiscal cartridge, allows change of the printing module in situations such as malfunctioning of the cutting mechanism or printing mechanism without the need to break seals and, consequently, interrupting the functioning of the fiscal cartridge, which can lead to intervention of an accredited inspector and the consequent bureaucratic procedures. In addition, it solves the problem of equipment downtime in the point of sale, since the maintenance time would take only a few minutes and could be performed at the site. In countries where this separation between printing module and the fiscal cartridge is not allowed, the solution is also simple, just extend the seal pin of the sealing device, fixing the printing module to the fiscal cartridge.

Conventionally, in countries that require keeping the records of the last five or ten years in the establishment, when the printing memory is full, the whole printer is stored, since the seal must remain unbroken. The printer for commercial automation described in this invention allows storing only the fiscal cartridges, which occupy less space, in addition to allowing the trader to purchase a new fiscal cartridge only and use the same printing module. Therefore, during an inspection, all that is needed is that a printing module and all fiscal cartridges pertaining to the storage period required be available, for the fiscal representative to access all the necessary data.

DESCRIPTION OF DRAWINGS

To facilitate the understanding and execution of this invention, the following figures are given for illustration purposes and do not restrict the final form of the invention. Each component or identical or similar part illustrated is identified by a corresponding number

BEST MODE

Figure 1:
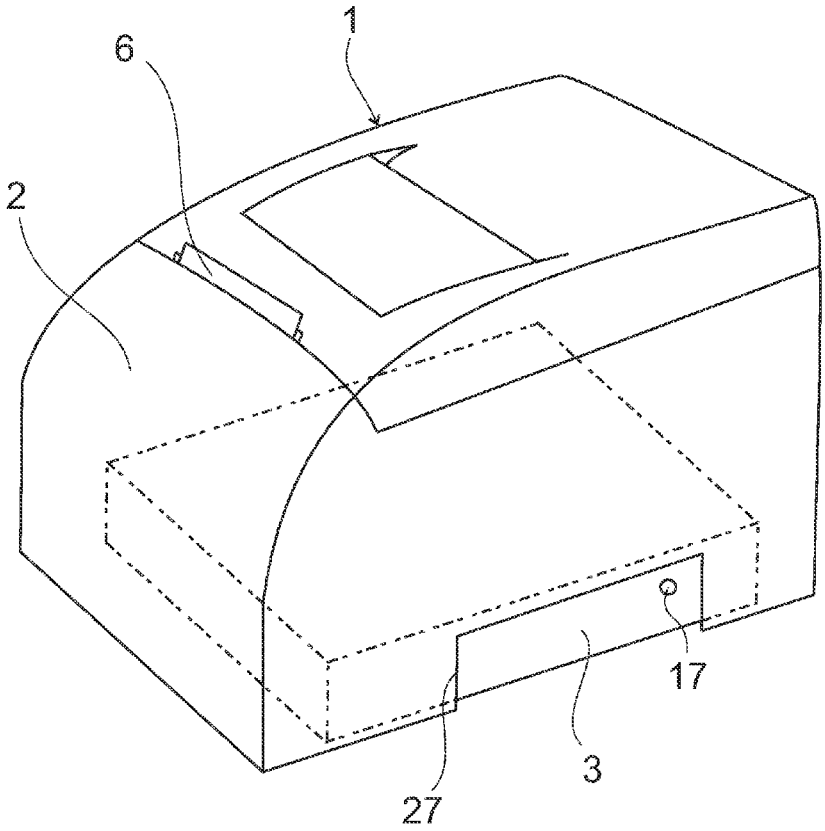
FIG. 1 shows a perspective view of the printer for commercial automation according to the present invention.
Figure 2:
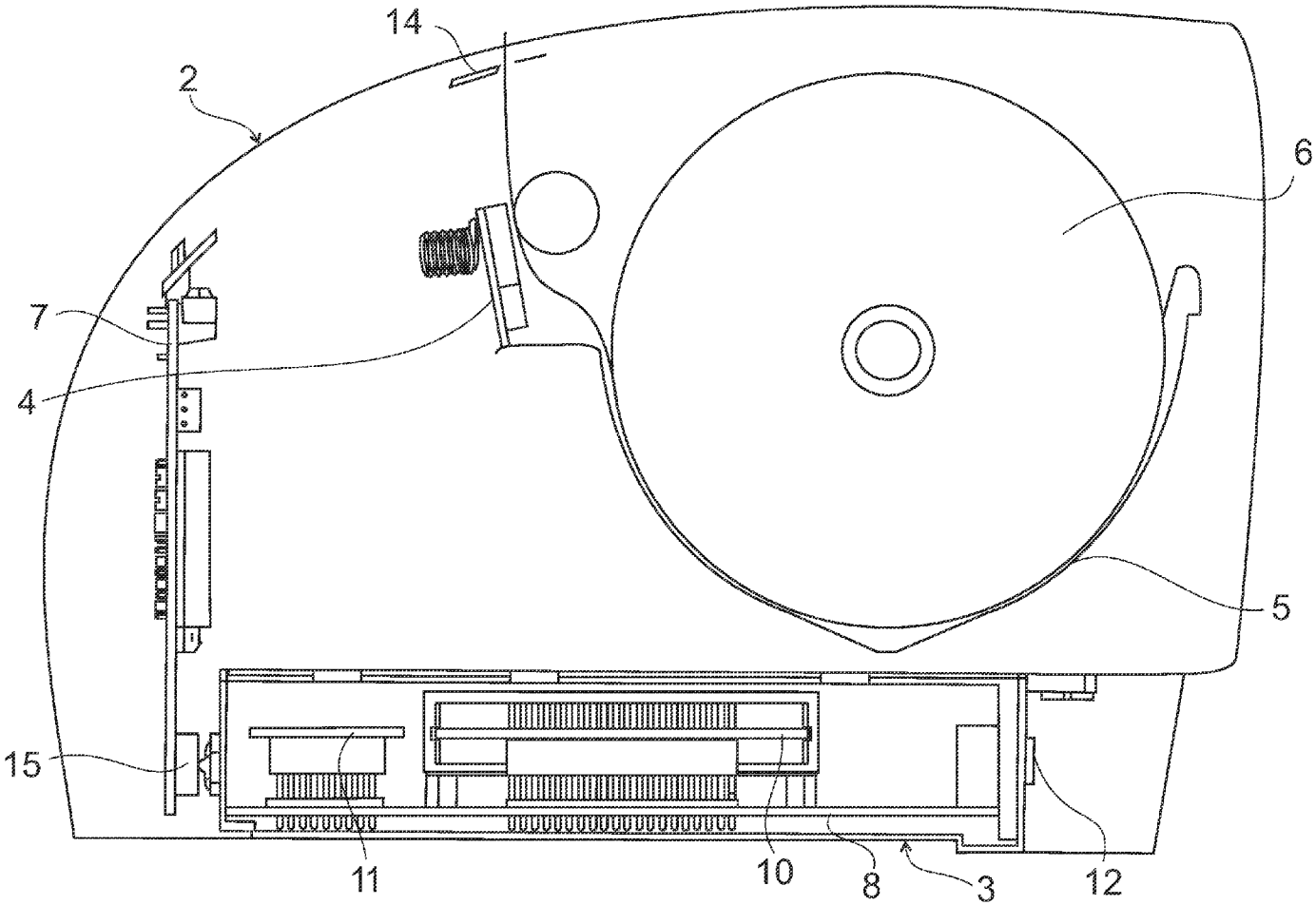
FIG. 2 shows a side view of the printer for commercial automation in cross section.
Figure 3:
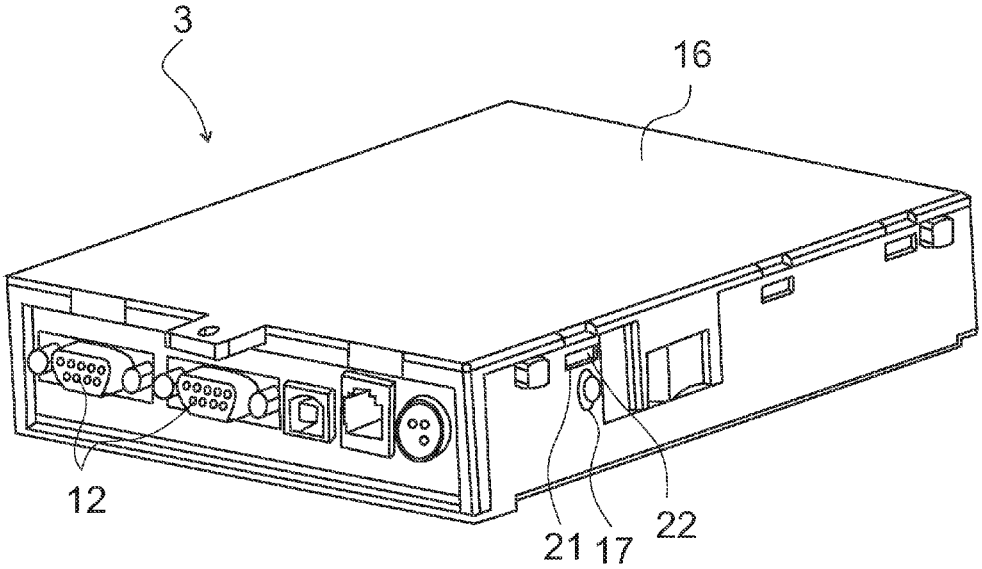
FIG. 3 shows a front perspective view of the fiscal cartridge.
Figure 4:
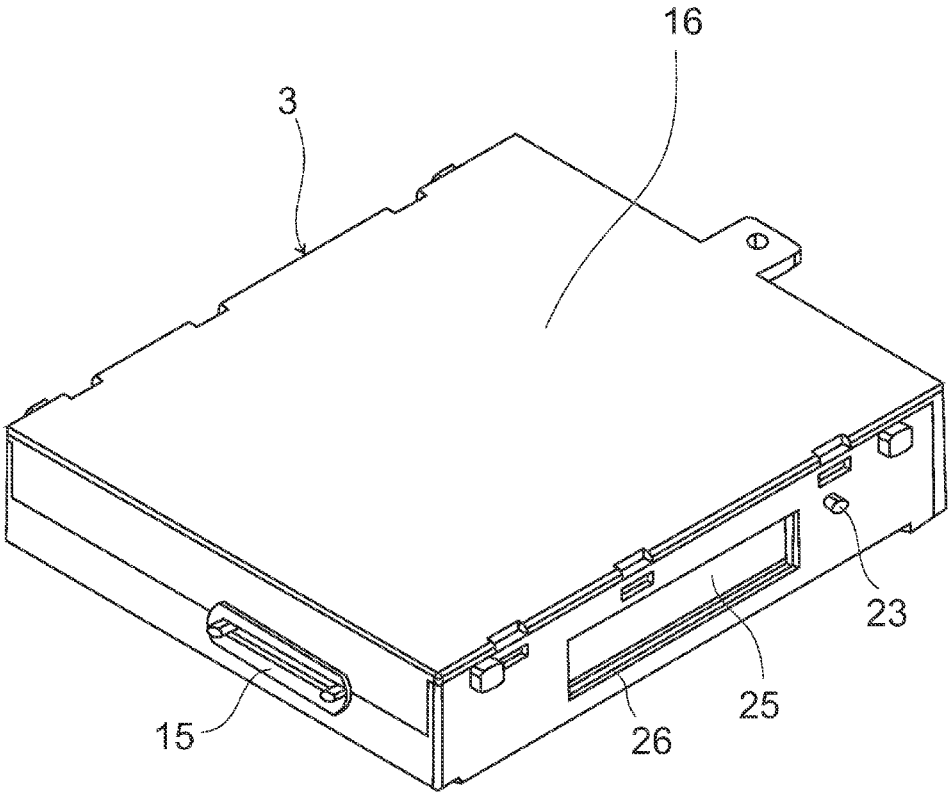
FIG. 4 shows a rear perspective view of the fiscal cartridge.

This invention consists of a printer for commercial automation (1) made up of a printing module (2) and a fiscal cartridge (3), in independent cabinets. Said printing module (2) comprises at least a printing mechanism (4), preferably with thermal printing, a support (5) for the paper roll (6), an auxiliary connection board (7) and its connection (15) with a fiscal control board (8).

Figure 6:
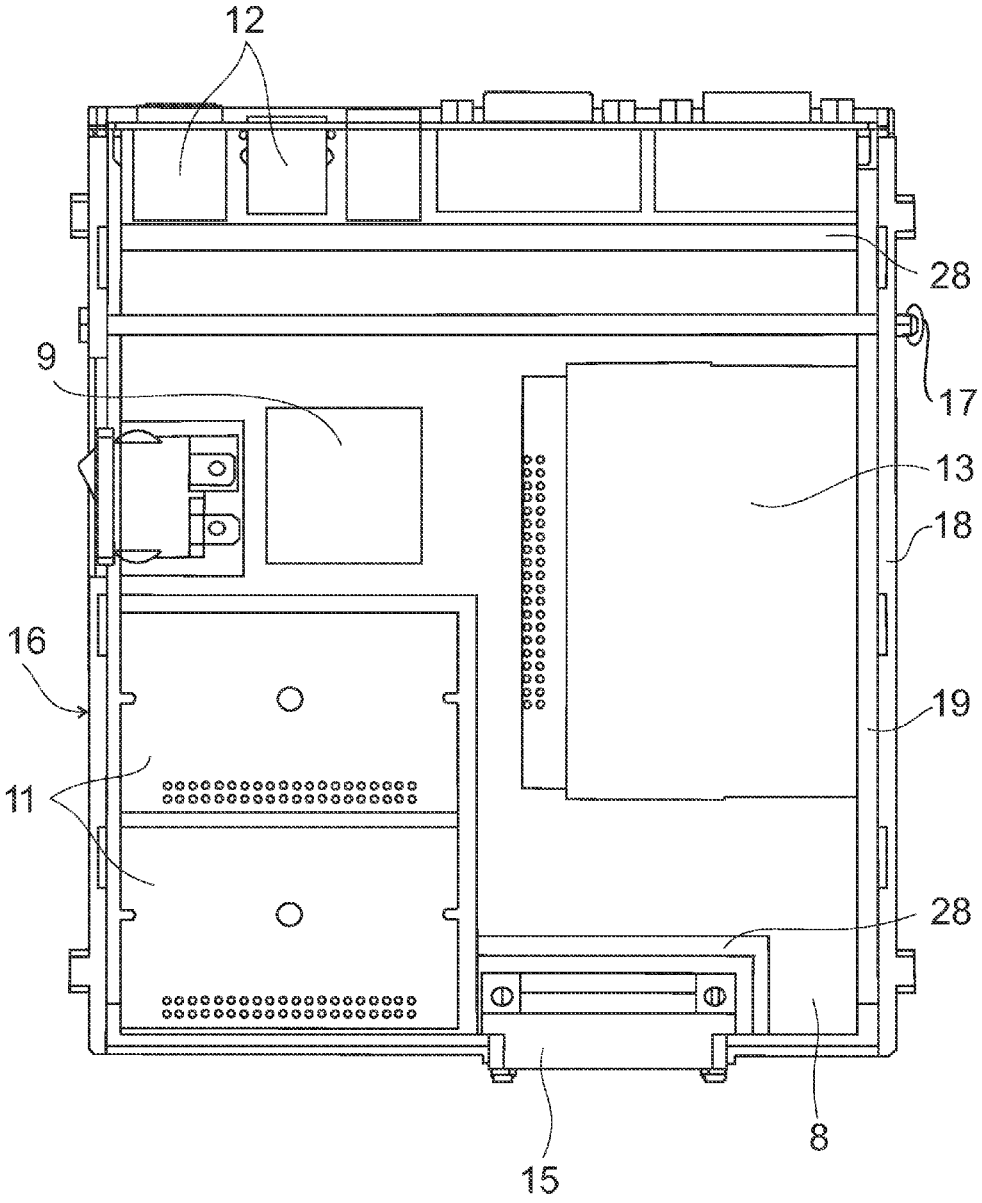
FIG. 6 shows a top view of the fiscal cartridge in transversal section according to the best mode of this invention.

In the best mode of this invention, said fiscal control board (8) has components arranged like: processor (9), non-volatile memory for storage (10), fiscal memories (11) and external interfaces (12), as shown in FIG. 6.

The processor (9) exclusively executes the instructions from the specific software, having access to the non-volatile memory for storage (10) and the fiscal memory (11).

The processor (9) receives information from an external computer through external interfaces (12) and sends the information to be printed to an auxiliary connection board (7). The processor (9) is also responsible for generating internal reports, such as Z reduction which is the daily report with all values of the daily commercial operation, and for executing the commands given by the fiscal representative during an audit or by the user during the printing.

The non-volatile memory for storage (10) consists of the memory, which stores all data necessary for full reproduction of all the documents issued by the printer for commercial automation (1) with fiscal functions, allowing reproduction of the data stored to a file in electronic mean, and allowing printing of second copies of the documents originally issued, thus replacing the second copy that was always previously printed. The non-volatile memory for storage (10) can be any storage device that does not allow deletion and modification of the data stored during the operation of the printer for commercial automation (1).

When the non-volatile memory for storage (10) is disconnected from the equipment, in case of running out or irrecoverable damage, the operation of the printer for commercial automation (1) is blocked.

Figure 7:
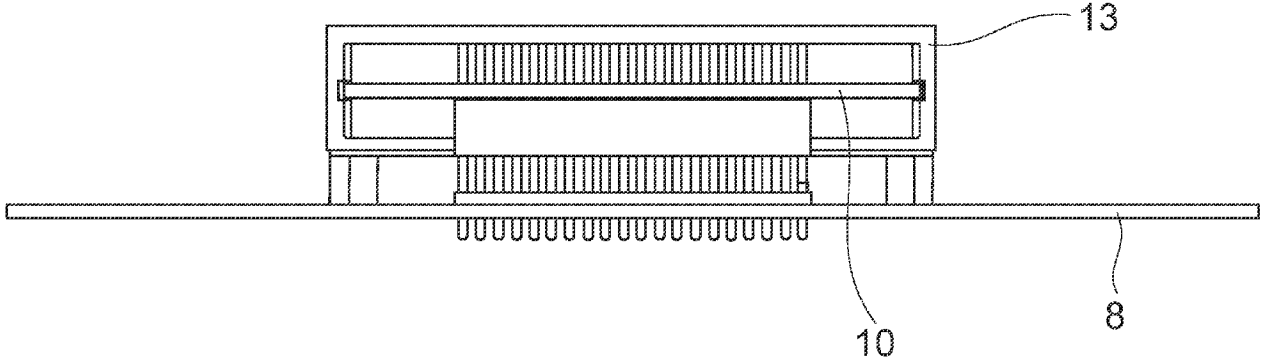
FIG. 7 shows a side view of the of the non-volatile memory housing according to the best mode of this invention.

To prevent displacement of the non-volatile memory for storage (10), it is fixed to the fiscal control board (8) by applying resin enveloping the entire non-volatile memory for storage (10). Furthermore, the non-volatile memory for storage (10) is preferably arranged inside the housing (13), as shown in FIG. 7.

The work memory consists of a modifiable storage device of the fiscal control board (8), used to record information of the equipment and parameters to program the functioning, of the establishment in which it is operating, accumulators and identification of products and services.

Figure 8:
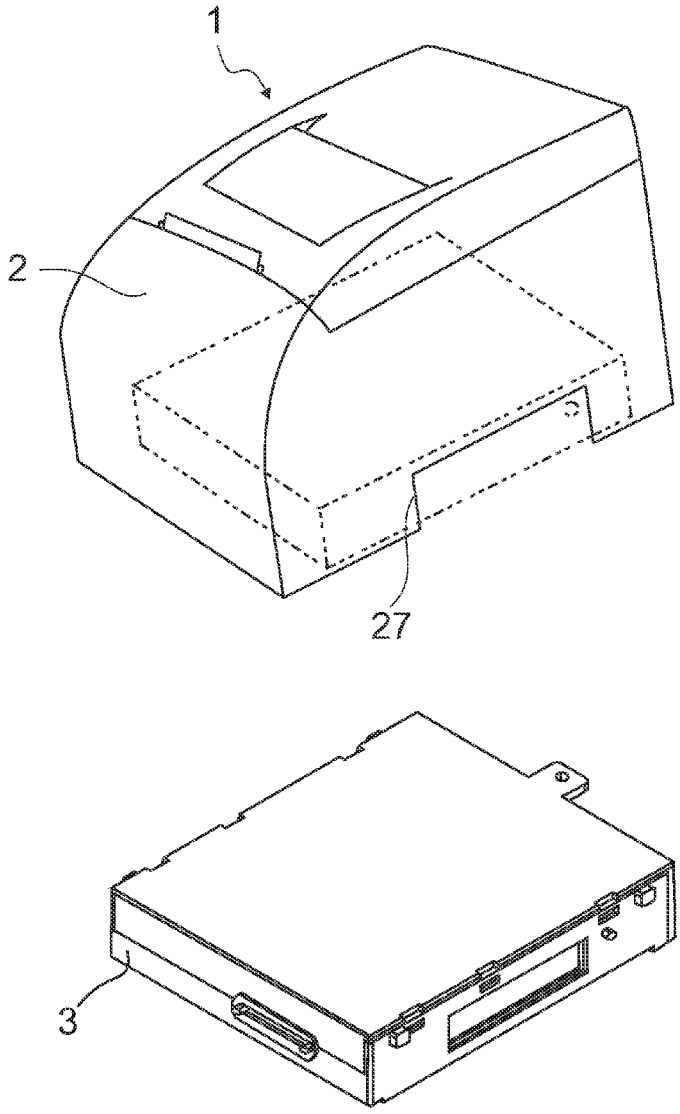
FIG. 8 shows a perspective view of the printing module separate from the fiscal cartridge.

In case of failure in the printing module (2), for example, in the printing mechanism (4), the fiscal cartridge (3) remains connected, for example, to the computer of the point of sales and only the printing module (2) is removed or replaced, as shown in FIG. 8. Once all the components responsible for control of the printer and fiscal operations are inside the fiscal cartridge (3), it is possible to remove and replace only the printing module (2) without the need to break the seal of the fiscal cartridge (3), waiving intervention of an accredited inspector.

MODE FOR INVENTION

The various modes of execution of this invention are not limited to the constructive details explained in this description and figures, to the extent that this invention can be conducted by other equivalent configurations. According to the referred illustrations, this invention has to do with a printer for commercial automation (1), made up of a printing module (2) and a modular cartridge, in independent cabinets but comprised in the same printer, being that said modular cartridge can be a fiscal cartridge (3) or a non-fiscal cartridge. Said printing module (2) comprises at least a printing mechanism (4), preferably thermal printing, a support (5) for the paper roll (6), an auxiliary connection board (7), and the latter's auxiliary connection board (7) to the control board, such as the fiscal control board (8).

Alternatively, the printer for commercial automation (1) can have a cutting mechanism (14) and other auxiliary printing devices, such as sensors, displays and buttons.

The printing mechanism (4) is chosen according to the user's requirements, and one of the printing mechanisms can be conventional, being controlled by the fiscal control board (8) by means of the auxiliary connection board (7). The auxiliary connection board (7) is connected electrically to the fiscal control board (8) by means of the connector (15), through which it receives the electrical signals to be printed and then sends said signals to the printing mechanism (4). The auxiliary connection board (7) is also responsible for the electrical connection of additional mechanisms, such as cutting mechanism (14), and other auxiliary printing devices, such as sensors, displays and buttons with the fiscal control board (8). The auxiliary connection board (7) is preferably arranged vertically in the front region of the printer for commercial automation (1). This way, the distance to the devices to be interconnected is minimized, also reducing the quantity of wires used and, consequently, the probability of electromagnetic interferences.

The fiscal control board (8) consists of the devices responsible for all the fiscal control functions and also for the printing control. In said fiscal control board (8), the components are arranged according to the local fiscal requirements, such as processor (9), memories (10) and (11) and external interfaces (12).

The arrangement of the fiscal control board (8) components can be altered, as well as the quantity and type of processor and memories used, and different components can also be added, according to the trader's need or fiscal requirements, for example, replacing both memories (11) by one with a higher capacity.

Due to the fiscal control board (8) being in an independent cabinet of the printing module (2), these changes in the fiscal cartridge (3) do not interfere in the printing module (2).

In cases in which there are no fiscal requirements, the modular cartridge consists of a non-fiscal cartridge, which is similar to a fiscal cartridge (3), but only with the components for printing control and external interfaces (9) according to the user's needs, such as serial, USB, WiFi, parallel or other external interface (12) technologies eventually used.

In this case, the functionality of the non-fiscal cartridge is reduced, not requiring a specific memory to store the fiscal information. Preferably, the non-fiscal cartridge preserves the same manner of being fixed to the printing module (2) as the fiscal cartridge (3). Optionally, a different connector (15) can be used for the non-fiscal cartridge, preventing the non-fiscal cartridge from being connected to a printing module (2) for fiscal cartridges (3). Thus, there can be printing modules (2) for fiscal printers and printing modules (2) for conventional or non-fiscal printers.

Alteration of the interfaces (12) or connector (15) interconnecting the auxiliary connection board (7) and the fiscal control board (8) prevents a fiscal cartridge (3) from being changed by a non-fiscal or conventional cartridge. This prevents a trader from trying to use a non-fiscal printer instead of a fiscal one, which would bring losses to the fiscal audit.

The fiscal control board (8) is fixed to the interior of a fiscal cartridge casing (16), the closing of said casing (16) being assured by means of a seal pin (23). The seal pin in turn is prevented from being removed by a seal (17). The casing (16) together with the seal (17) prevents physical access to its components without evidencing violation of the fiscal cartridge (3). Also, according to the legal requirements, the casing (16) can present the identification and other necessary data of the fiscal cartridge (3).

Figure 5:
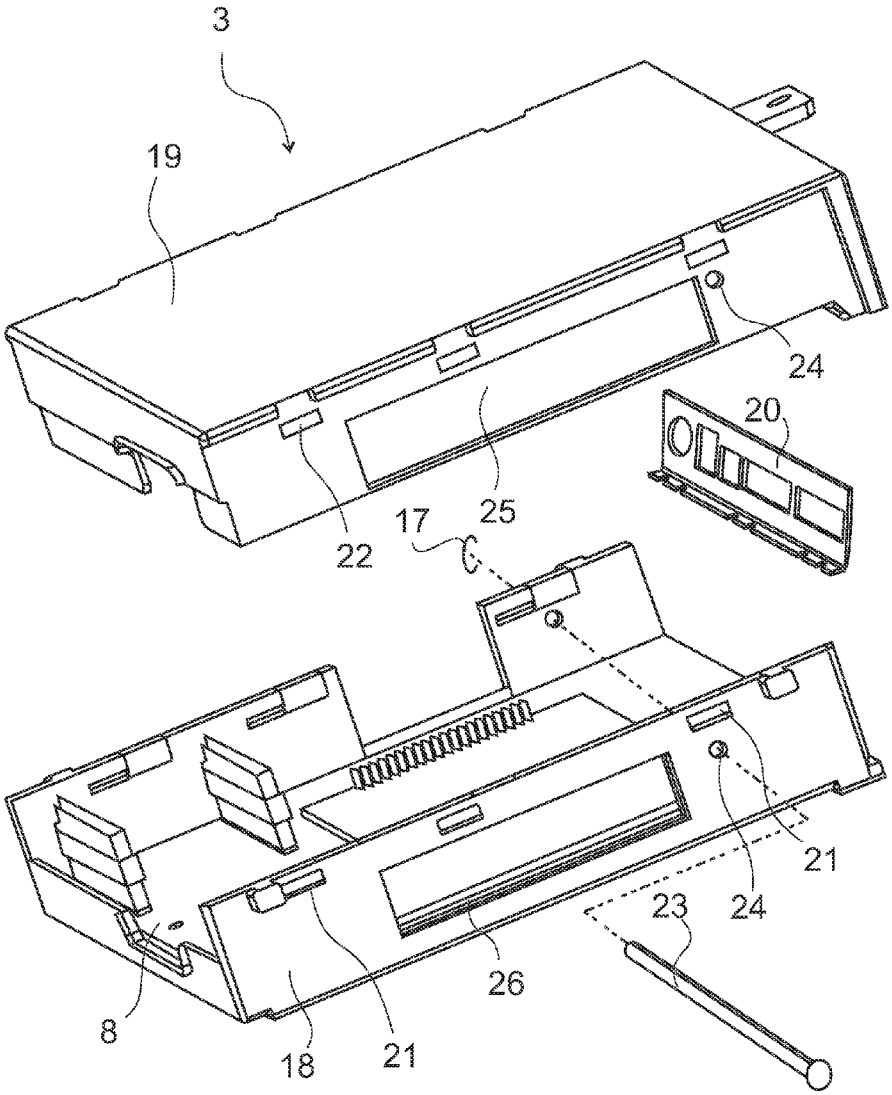
FIG. 5 shows an expanded perspective view of the fiscal cartridge.

The casing (16) is preferably made up of a base (18) and a cover (19), as shown in FIG. 5. The base (18) of the casing (16) consists of a rectangular base hollowed out prism in which the fiscal control board (8) is supported. The cover (19) of the casing consists of a rectangular top hollowed out prism with size a little smaller than the base (18), so as to allow fitting between the base (18) and the cover (19). Orifices are arranged on the anterior sides for the connector (15) between the auxiliary connection board (7) and the fiscal control board (8) and a metallic plate (20) is fixed on the posterior sides, equipped with orifices for the external interfaces (12).

Also, on the lateral sides of the casing (16) base (18), fitting orifices (21) are arranged with 'L' profile, being that on the vertical part of said fitting orifices (21) slide fitting projections (22) of the cover (19) lateral walls during closing of the casing (16). To lock the casing (16), the fitting projections (22) slide on the horizontal part of the fitting orifices (21). To assure a tamperproof casing (16), the seal pin (23) is positioned, crossing orifices (24) of the base (18) and cover (19), followed by placing of the seal (17).

Also, identification of the fiscal cartridge (3) and other necessary data can be arranged in an identification region (25) of the cover (19), which is externally visible by means of a window (26) of the base (18) of the casing (16). This information is visible due to an orifice (27) presented in the lower region of the printing module (2) cabinet.

In order to prevent unauthorized physical access through the orifices of the external interfaces (12), in addition to the metallic plate (20), which is arranged on the posterior side of the casing (16), the fiscal cartridge (3) is also equipped with an internal wall (28), positioned in front of the external communication interfaces (12), extending from the fiscal control board (8) up to the cover (19) of the casing (16). Likewise, an internal wall (28) is also positioned behind the connector (15).

In case of failure in the printing module (2), for example, in the printing mechanism (4), in countries where it is allowed, the fiscal cartridge (3) remains connected, for example, to the computer and only the printing module (2) is removed or replaced, as shown in FIG. 8. The printing module (2) can be replaced by a similar one without breaking of the seal (17) or any physical intervention in the fiscal cartridge (3), and the printer for commercial automation (1) may resume its functioning without the need for intervention by an accredited inspector. Furthermore, to store the records of the last five or ten years, only the fiscal cartridge (3) needs to be stored, and no longer the whole printer for commercial automation, as was the case with the conventional equipment. In case of inspections, all that is needed is a printing module (2) that can be connected to any one of the fiscal cartridges (3) to extract the necessary data in a quick and practical manner.

Through said orifice (27), slides the seal pin (23) together with the seal (17) when separating the fiscal cartridge (3) sealed in relation to the printing module (2), to disconnect from the connector (15). For this, there is a minimum distance of 1 cm between positioning of the seal pin (23) and the wall of the orifice (27) when the fiscal cartridge (3) and the printing module (2) are perfectly fitted.

Figure 9:
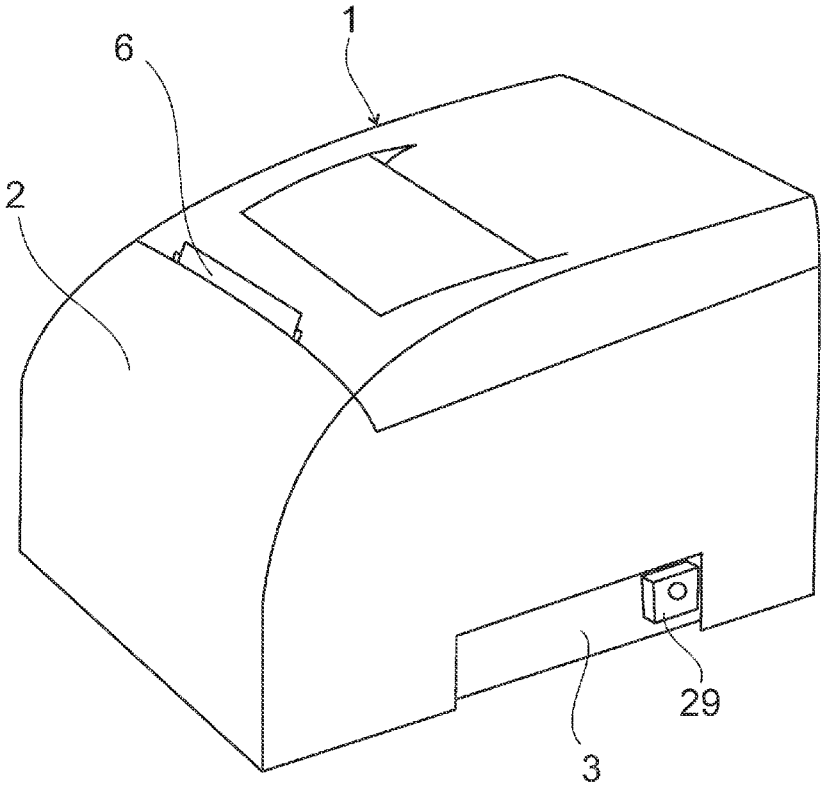
FIG. 9 shows a perspective view of the printer for commercial automation with the sealing preventing separation between the fiscal cartridge and the printing module.
Figure 10:
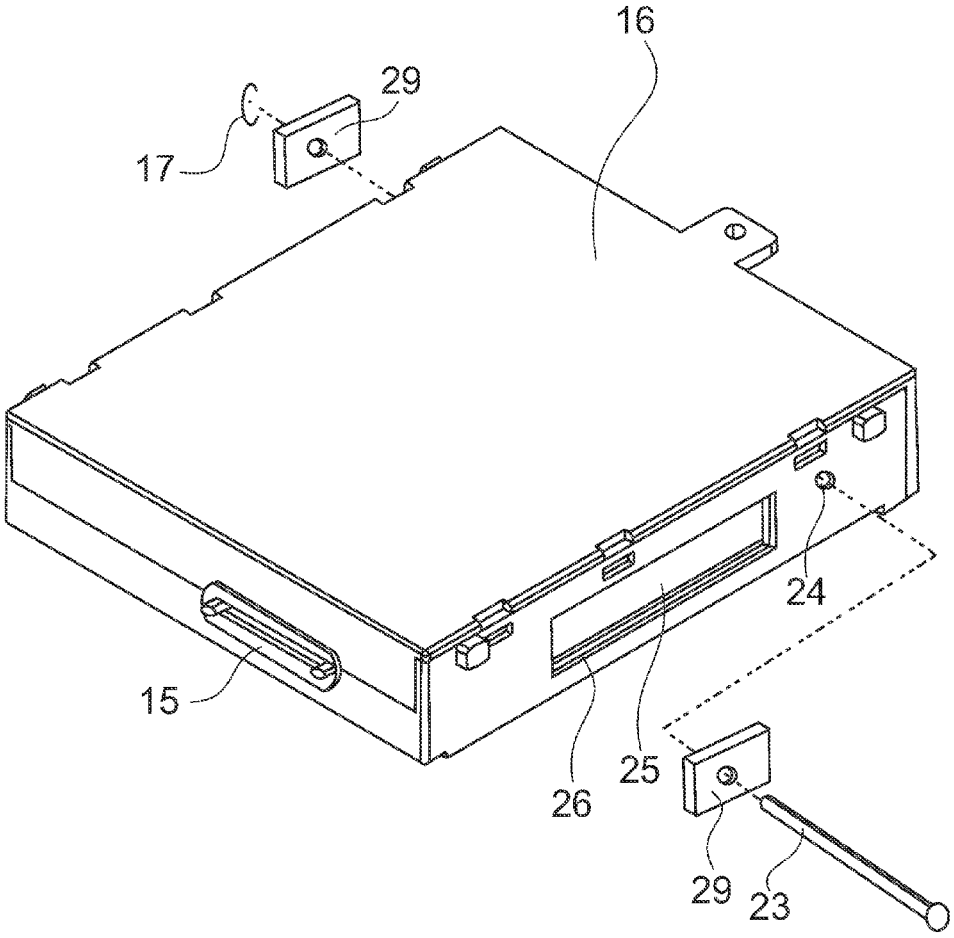
FIG. 10 shows an expanded perspective view of the fiscal cartridge with the sealing preventing separation between the fiscal cartridge and the printing module.

In countries where separation between the printing module (2) and fiscal cartridge (3) is not allowed, the seal pin (23) is extended, also crossing shims (29), arranged one on each side of the fiscal cartridge (3). As shown in FIGS. 9 and 10, the shims (29) are crossed by the seal pin (23) and extend up to the lateral wall of the orifice (27) of the printing module (2) cabinet. This way, movement of the fiscal cartridge (3) to disconnect the connector (15) without breaking the seal (17) is not allowed.

INDUSTRIAL APPLICABILITY

This invention has wide industrial application in printers for commercial or bank automation, preferably for use in situations requiring fiscal control of printing, as is the case in countries with fiscal requirements, being adapted to the different situations, and also for use in conventional situations without the need to control and record the printed information, as in non-fiscal printers. In both cases, the same printing module is used, with only the components and arrangements in said fiscal or non-fiscal cartridge varying, depending on the situation.

The invention claimed is:

1. A printer comprising:

a printing module disposed in a first cabinet of the printer, the printing module including a printing mechanism for printing on paper and at least one electrical connector; and a modular cartridge disposed in a second cabinet of the printer, the second cabinet of the printer being configured to interchangeably receive one of a first type of modular cartridge and a second type of modular cartridge;

wherein the first type of modular cartridge is a fiscal modular cartridge that includes a first processor, a first memory, and a first electrical connector configured to electrically connect with the at least one electrical connector of the printing module, the first processor being configured to control the printing mechanism and to store an electronic copy of each financial transaction sent to the printing mechanism in the first memory in a manner in which the electronic copy cannot be deleted from the first memory by the first processor; and wherein the second type of modular cartridge is a non-fiscal modular cartridge that includes a second processor, a second memory, and a second electrical connector configured to electrically connect with the at least one electrical connector of the printing module, the second processor being configured to control the printing mechanism but having no ability to store an electronic copy of each financial transaction sent to the printing mechanism;

wherein the first processor, the first memory, and the first connector are mounted to a fiscal control board, and wherein the first memory includes a non-volatile memory that is encapsulated in a resin to prevent removal of the non-volatile memory from the fiscal control board without evidencing the removal of the non-volatile memory; and wherein at least one end of the seal pin is encapsulated within a seal to prevent removal of the seal pin from the casing without evidencing damage to the seal.

2. The printer of claim 1, wherein the seal pin is dimensioned to have a length that extends through the first cabinet of the printer and prevents removal of the first type of modular cartridge from the printer without evidencing damage to the seal.

3. The printer of claim 1, wherein the casing includes a base and a cover, the base and the cover being configured to fit together so as to form a substantially closed casing except for a first opening for the first electrical connector and one or more second openings for one or more external communication interfaces used to electrically connect the printer to an external computer.

4. The printer of claim 3, wherein each of the base and the cover has a pair of lateral side walls, each lateral sidewall of the pair of lateral sidewalls of the base and the cover having an aperture formed therein that is configured to receive the seal pin and prevent separation of the base from the cover without removal of the seal pin.

5. The printer of claim 4, wherein the casing includes an internal wall disposed adjacent to the one or more external communication interfaces to prevent access to an interior of the casing via the one or more second openings.

6. The printer of claim 5, wherein the internal wall is a first internal wall, and wherein the casing further includes a second internal wall disposed adjacent to the first electrical connector to prevent access to the interior of the casing via the first opening.

7. The printer of claim 4, wherein the casing includes an internal wall disposed adjacent to the first electrical connector to prevent access to the interior of the casing via the first opening.

8. The printer of claim 3, wherein the casing includes at least one internal wall disposed adjacent to at least one of the first electrical connector and the one or more external communication interfaces to prevent access to the interior of the casing via at least one of the first opening and the one or more second openings, respectively.

9. The printer of claim 1, wherein the printing module includes a thermal printing mechanism for printing on the paper, a paper roll support, and a connection board that includes the at least one electrical connector.

10. The printer of claim 9, wherein the connection board includes at least one additional connector to connect to at least one of a paper cutting mechanism, a sensor, a display and a button.

11. The printer of claim 9, wherein the connection board is positioned vertically in the first cabinet in a front region of the printer and wherein the modular cartridge is positioned horizontally in the second cabinet in a lower region of the printer.

12. The printer of claim 1, wherein the printing module is configured for at least one of removal, repair, and replacement without disturbing a fiscal integrity of the first type of modular cartridge.

13. The printer of claim 1, wherein the first type of modular cartridge includes a plurality of different modular cartridges of the first type, each of the plurality of different modular cartridges being configured according to fiscal requirements of different countries.

14. The printer of claim 1, wherein the at least one electrical connector of the printing module includes a first electrical connector configured to connect with the first electrical connector of the first type of modular cartridge, and a second electrical connector configured to connect with the second electrical connector of the second type of modular cartridge, the first electrical connector of the first type of modular cartridge being at least one of electrically and mechanically different than the second electrical connector of the second type of modular cartridge.

* * * * *